US009312622B2

(12) United States Patent
Windenberger et al.

(10) Patent No.: US 9,312,622 B2
(45) Date of Patent: Apr. 12, 2016

(54) CONNECTING ELEMENT FOR A STORAGE BATTERY

(71) Applicant: MULTI-HOLDING AG, Allschwil (CH)

(72) Inventors: Michel Windenberger, Lutterbach (FR); Aurélien Hell, Ligsdorf (FR)

(73) Assignee: Multi-Holding AG, Allschwil (CH)

( * ) Notice: Subject to any disclaimer, the term of this patent is extended or adjusted under 35 U.S.C. 154(b) by 0 days.

(21) Appl. No.: 14/362,833

(22) PCT Filed: Nov. 12, 2012

(86) PCT No.: PCT/EP2012/072380

§ 371 (c)(1),
(2) Date: Jun. 4, 2014

(87) PCT Pub. No.: WO2013/083361

PCT Pub. Date: Jun. 13, 2013

(65) Prior Publication Data

US 2014/0308837 A1 Oct. 16, 2014

(30) Foreign Application Priority Data

Dec. 5, 2011 (EP) ..... 11191908

(51) Int. Cl.
*H01R 13/04* (2006.01)
*H01R 4/48* (2006.01)
(Continued)

(52) U.S. Cl.
CPC ..... *H01R 13/04* (2013.01); *H01R 4/4863* (2013.01); *H01R 11/289* (2013.01);
(Continued)

(58) Field of Classification Search
CPC ..... H01R 13/62; H01R 13/627; H01R 43/26; H01R 12/724; H01R 13/6278
USPC ..... 439/345
See application file for complete search history.

(56) References Cited

U.S. PATENT DOCUMENTS 4,270,827 A * 6/1981 Potgieter ..... H01R 11/282 439/428
6,030,722 A * 2/2000 Kuboshima ..... H01M 2/206 429/178
2008/0146066 A1* 6/2008 Ice ..... H05K 9/0058 439/345

FOREIGN PATENT DOCUMENTS

DE 197 14 511 A1 11/1997
FR 2 953 333 A1 6/2011

OTHER PUBLICATIONS

International Preliminary Report on Patentability dated Jun. 19, 2014, issued by the International Searching Authority in corresponding International Application No. PCT/EP2012/072380.
(Continued)

*Primary Examiner* — Abdullah Riyami
*Assistant Examiner* — Justin Kratt
(74) *Attorney, Agent, or Firm* — Sughrue Mion, PLLC

(57) ABSTRACT

The invention relates to a connection arrangement (1) comprising a connecting pin (2) extending along a first axis (AI), and a connecting element (7) having an electrically insulating housing element (8) comprising a housing wall (10) defining an inner space (9), wherein the contact element (13) is arranged in the inner space (9) of the housing element (8), wherein the contact element (13) can be connected to the connecting pin (2) along said first axis (AI), wherein the connecting element (7) comprises a securing element (8, 22) that can be moved relative to the contact element (13) from a securing position into a release position, and if the contact element (13) is in a contacting state with the connecting pin (2), the securing element (8, 22) is in the securing position, in which said securing element is connected to the securing region (4) of the connecting pin (2) in a form-fitting manner, by means of which the connection between the connecting element (7) and the connecting pin (2) is secured in a form-fitting manner, and the security element (8, 22) can be moved from the securing position into the release position, wherein in the release position the form-fit between the securing element (8, 22) and the connecting pin (2) is removed and thus a movement between the contact element (13) and the connecting pin (2) is rendered possible.

15 Claims, 5 Drawing Sheets

(51) Int. Cl.

| | |
|---|---|
| ***H01R 11/28*** | (2006.01) |
| ***H01R 13/193*** | (2006.01) |
| *H01R 13/627* | (2006.01) |
| *H01R 12/72* | (2011.01) |
| *H01R 43/26* | (2006.01) |
| *H01R 13/62* | (2006.01) |

(52) U.S. Cl.
CPC ..... *H01R 13/193* (2013.01); *H01R 12/724* (2013.01); *H01R 13/62* (2013.01); *H01R 13/627* (2013.01); *H01R 13/6278* (2013.01); *H01R 43/26* (2013.01)

(56) References Cited

OTHER PUBLICATIONS

International Search Report of PCT/EP2012/072380, dated Feb. 14, 2013.

* cited by examiner

CONNECTING ELEMENT FOR A STORAGE BATTERY

CROSS REFERENCE TO RELATED APPLICATIONS

This application is a National Stage of International Application No. PCT/EP2012/072380 filed Nov. 12, 2012, claiming priority based on European Patent Application No. 11191908.0 filed Dec. 5, 2011, the contents of all of which are incorporated herein by reference in their entirety.

TECHNICAL FIELD

The present invention relates to a connecting element for a storage battery according to the preamble of claim 1.

PRIOR ART

Connecting elements for storage batteries are known from the prior art. For example, a storage battery may be a battery as is used in vehicles, that is to say cars or trucks. This storage battery is connected via a connecting terminal to the electric network of the vehicle. The storage battery usually comprises a connecting pin, via which the connecting terminal is then contacted with the storage battery.

Such connecting elements may also serve for the connection in series and/or in parallel of battery sets.

Such terminals were conventionally formed via corresponding screw connections, which provided a clamping effect on the terminal. Here, it was disadvantageous that the screw was made of conductive material, which was disadvantageous for the user or for the car mechanic, in particular if he has unintentionally provided a contact between the positive pole and the negative pole.

A further connecting structure which no longer has this disadvantage is known from U.S. Pat. No. 4,270,827. Here, the connection between connecting element and connecting pin is provided via a spring connection.

DISCLOSURE OF THE INVENTION

Proceeding from this prior art, the object of the invention is to specify a connecting element for a storage battery which overcomes the disadvantages of the prior art. In particular, the mechanical connection between storage battery and connecting element is to be secured in an improved manner against unintentional detachment, wherein, at the same time, the intentional separation of the connection between connecting element and storage battery is not to be increased unduly.

Such an object is achieved by the connecting arrangement according to claim 1. Accordingly, a connecting arrangement comprises a connecting pin extending along a first axis and having a contact region, a securing region and a connecting region, and a connecting element having an electrically insulating housing element with a housing wall that delimits an interior space and having a contact element comprising a first contact portion for electrically connecting the connecting element to the contact region of the connecting pin and comprising a second contact portion for electrically connecting the connecting element to the external electrically conductive element. The contact element is arranged in the interior space of the housing element, wherein the contact element can be connected along said first axis to the connecting pin, such that an electric contact can be established between the contact element and the connecting pin. The connecting pin thus projects into the interior space of the housing element. The connecting element has a securing element that is movable relative to the contact element from a securing position into a release position. The securing element is thus movable, in particular slidable, with respect to the contact element. If the contact element is contacted with the connecting pin, the securing element is in the securing position, in which it is connected via a form fit to the securing region of the connecting pin, whereby the connection between connecting element and connecting pin is secured in a form-fitting manner. The securing element can be moved from the securing position into the release position, wherein, in the release position, the form fit between securing element and the connecting pin is cancelled and a movement between contact element and connecting pin is thus enabled, whereby the connection can be cancelled.

Due to the arrangement of the securing element, which is movable relative to the contact element, it is possible to prevent the connection between connecting pin and connecting element from detaching unintentionally. Further, due to the slidability between the securing element and the contact element, a simple separation of the connection is nevertheless achieved.

The interior space is accessible through openings in the housing wall, wherein preferably one opening is arranged per contact region. As a result, the connecting pin projects through one of these openings into the interior space or the housing element, respectively.

The securing element preferably constitutes an integral part of the housing element, wherein the housing element is movable as a whole relative to the contact element. In other words, it can also be said that the securing element is formed or molded rigidly on the housing element and extends therefrom. A particularly simple structure can thus be created, and the arrangement of a separate securing element, which can additionally also become lost during use, is superfluous. The sliding of the housing as a whole relative to the contact element and therefore also relative to the connecting pin if the connecting element is in contact with the connecting pin further has the advantage that the user has a greater area of engagement in order to grasp the connecting element when detaching the connection.

The securing element or the housing element, respectively, is preferably movable in a direction at right angles to said first axis, that is to say to the axis of the connecting pin.

The securing element is preferably provided by the edge region or the part of an edge region of an opening in the housing wall. Alternatively, the securing element extends away from the housing wall and forms a tab which engages with the securing region of the connecting pin.

The securing element is preferably at least part of an edge region of an opening in the housing wall, wherein the connecting pin projects through said opening into the housing element.

The securing element preferably projects into said opening and thus reduces the cross section of said opening in part. Alternatively, the securing element is provided by the edge region of the opening itself, wherein the opening is offset eccentrically with respect to the first axis of the connecting pin or of the contact element, respectively.

The securing region of the connecting pin preferably has the form of a recess, in particular the form of a furrow or groove, with which the securing element engages or into which the securing element projects, respectively. Said recess provides here a stop face which is oriented at an angle, in particular at right angles, to said first axis, wherein the securing element is in contact with this stop face or rests against this stop face when attempting to separate the connection, respectively. If the connecting element is to be separated from the connecting pin, the securing element has to be removed from the region of the stop face.

The connecting element further comprises a restoring element which provides a restoring force on the securing element in a direction from the release position into the securing position, such that the securing element is held in the securing position with the disappearance of an actuation force acting against the restoring force. A simple positioning in the securing position is thus achieved.

The restoring element is preferably a spring means, in particular a compression spring, arranged between the housing element and the contact element.

The housing element preferably comprises a stop element, wherein the stop element serves to delimit the movement between the housing element and contact element or to take up the restoring force if the contact element and connecting pin are in the separated state, respectively.

Further embodiments are specified in the dependent claims.

BRIEF DESCRIPTION OF THE DRAWINGS

Preferred embodiments of the invention will be described hereinafter on the basis of the drawings, which serve merely for explanatory purposes and are not to be interpreted as limiting. In the drawings.

DESCRIPTION OF PREFERRED EMBODIMENTS

Figure 1:
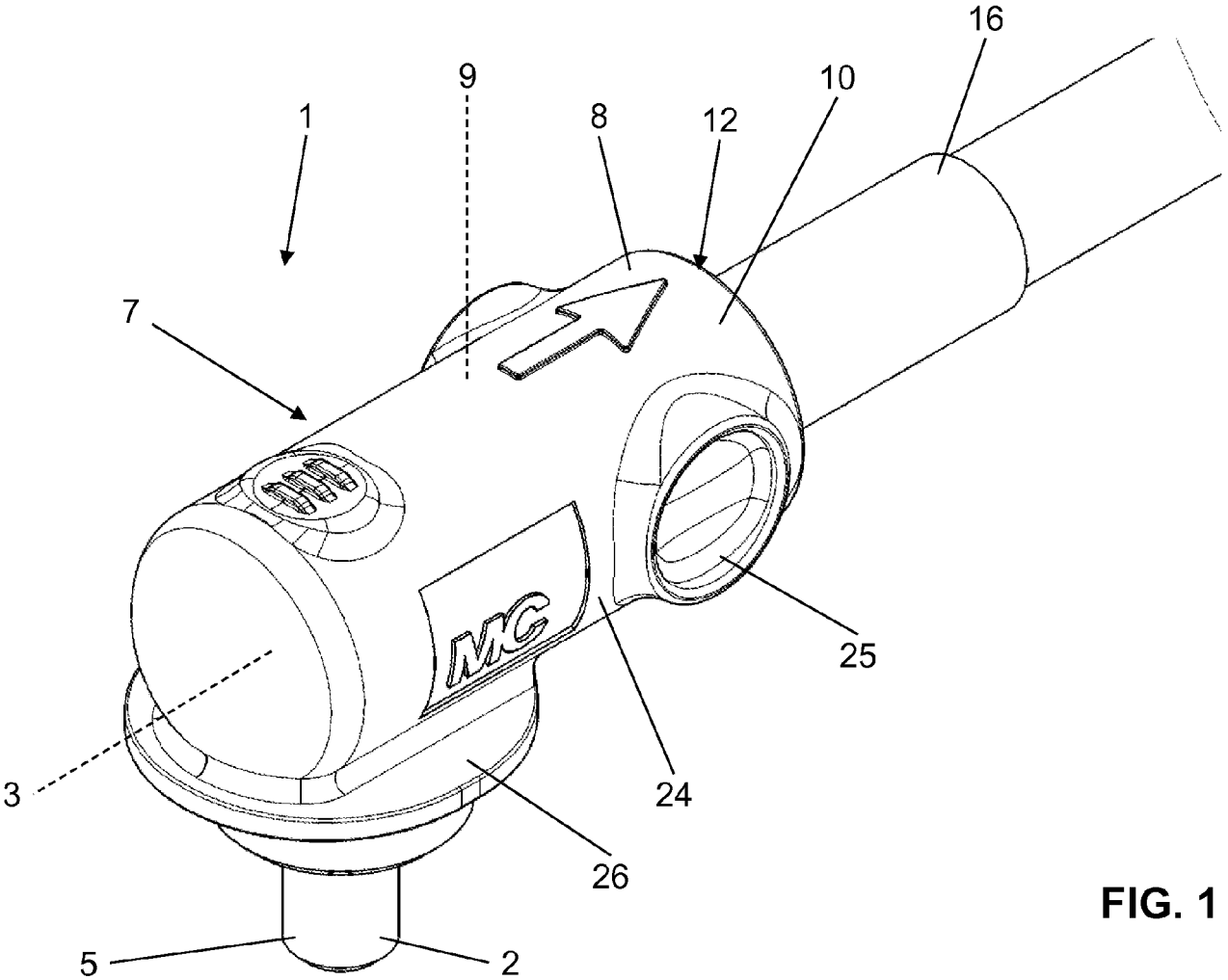
FIG. 1 shows a perspective view of the connecting element according to the present invention.
Figure 2:
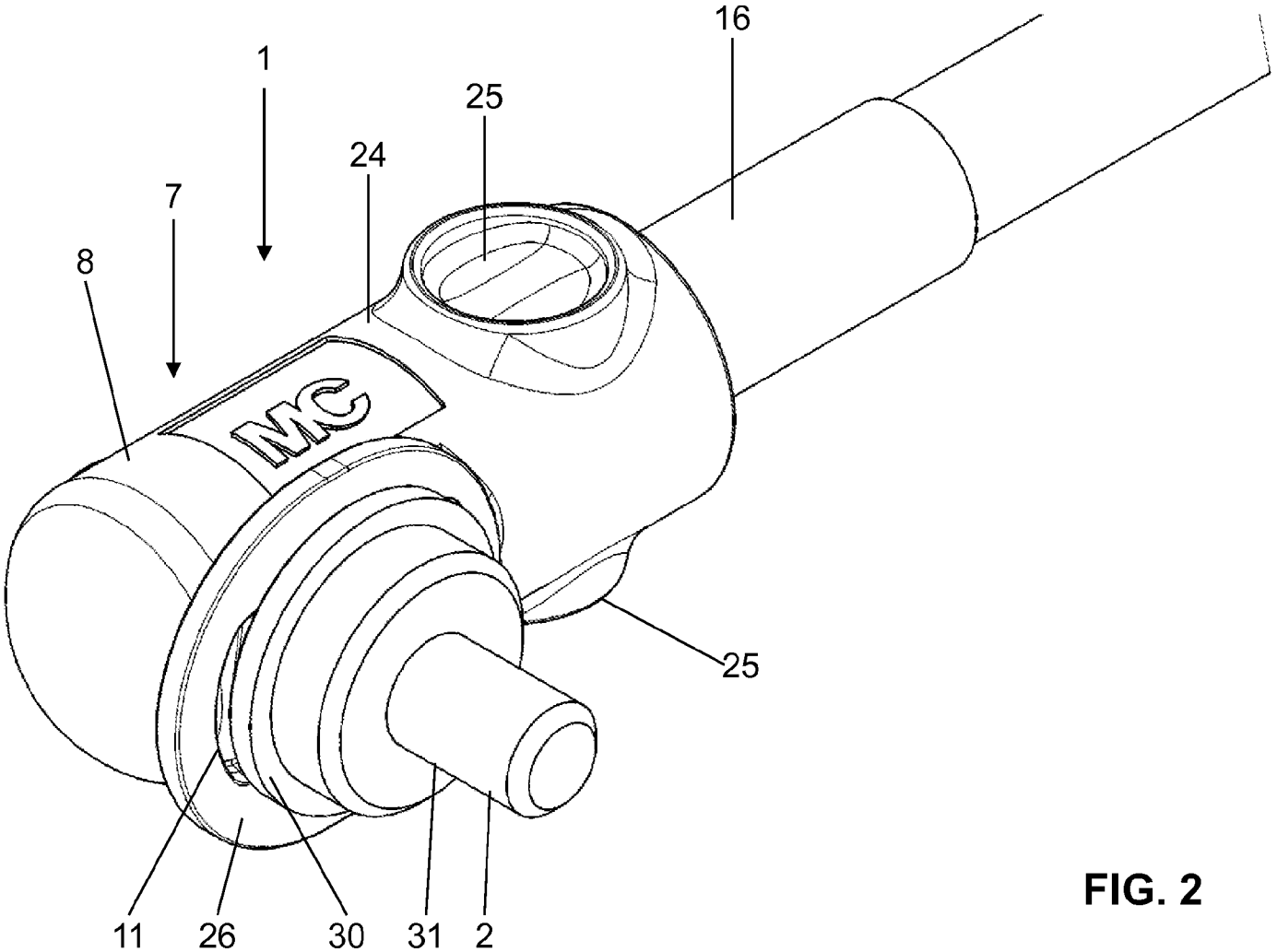
FIG. 2 shows a perspective view of the connecting element according to FIG. 1 from a different perspective.

Perspective views of a connecting arrangement 1 are shown in FIGS. 1 and 2. The connecting arrangement basically comprises a connecting pin 2 and a connecting element 7, wherein an electric contact is to be established between connecting pin 2 and connecting element 7.

The connecting pin 2, for example, can be part of a storage battery, such as a battery for a vehicle, or can be part of another electric device. The connecting pin can be seen particularly well in FIG. 4. The connecting pin 2 extends here in the direction along a first axis A1 and comprises a contact region 3, a securing region 4 and a connecting region 5. The contact region 3 is substantially cylindrical in shape here. The securing region 4, which adjoins the contact region 3 directly in the direction of the axis A1, is likewise cylindrical in shape and has a smaller diameter than the contact region 3. The connecting region 5, which adjoins the securing region 4 opposite the connecting region 5 can be formed arbitrarily. The form of the connecting region 5 is substantially dependent on the electric device as mentioned at the outset. Here, a flange 30 comprises an adjoining thread portion 31, via which the connecting region 5 is connected to the electric device. The flange 30 has a larger diameter than the securing region 4, such that a corresponding peripheral groove or furrow 32 is created, which constitutes the securing region 4.

The connecting element 7 basically comprises a housing element 8 that insulates the electric current, a contact element 13, and a securing element 22.

The housing element 8 comprises a housing wall 10 delimiting an interior space 9. The interior space 9 is accessible through openings 11, 12, which penetrate the housing wall 10. The securing element 22 is part of the housing element 8 in the present embodiment.

As mentioned above, the connecting element 7 further comprises a contact element 13, which serves to electrically contact the connecting pin 7. The contact element 13 is arranged here in the interior space 9 of the housing element 8. The contact element 13 is connectable to the connecting pin 2 along said first axis A1, wherein an electric contact between connecting pin 2 and contact element 13 is established via this connection.

The securing element 8 is movable relative to the contact element 13 from a securing position into a release position. The movement is preferably performed by hand. If the contact element is contacted with the connecting pin 2, the securing element 8, 22 is thus in the securing position, in which the securing element 8, 22 is connected via a form fit to the securing region 4 of the connecting pin 2. In this way, that is to say by the securing element 8, 22, the connection between connecting element 7 and connecting pin 2 is secured in a form-fitting manner against unintentional detachment. The securing element 8, 22 is movable from the securing position into the release position, wherein, in the release position, the form fit between the securing element 8, 22 and connecting pin is cancelled, such that a movement between contact element 13 and connecting pin 2 is enabled.

A preferred embodiment of the securing element 8, 22 will now be explained with reference to FIGS. 3, 4 and 5. The securing element is part of the housing element 8 here, wherein the securing element 22 is formed on the housing element 8. This is preferably a rigid forming, which is understood to mean that there is to be no relative movement between the 20 housing element 8 and securing element 22. In other words: the securing element 22 and housing elements 8 are formed in one piece with one another. The securing element 22 here forms part of the housing wall 10.

It can also be said that the securing element 8, 22 is part of an edge region of an opening 11 in the housing wall 10, wherein the connecting pin 2 projects through said opening 11 into the housing element, and wherein the securing element 8, 22 projects into said opening 11 and reduces the cross section of said opening 11 in part. The securing element 8, 22 may be formed here as a tab 33, which projects into the opening 11. This is shown in FIG. 5. The tab 33 projects as an integral component part away from the housing element 8 into the opening 11 and thus slightly reduces the cross section of the tab. This is a rigid forming of the tab 33 on the housing element. The tab 33 also has a concave rounded portion here, which improves the positioning between the tab and securing element 4, such as the furrow or the groove 32, respectively.

Alternatively, the securing element 8, 22 may easily constitute part of the side wall of the opening 11, wherein this part then provides the form-fitting engagement with the securing region 4. As can be seen from FIG. 3, the opening 11 may also be formed in a circular manner or oval manner as a slot, wherein the opening 11 in the securing position is then arranged eccentrically relative to the first axis A1 or relative to the first contact portion 14, respectively. The center axis and the first axis A1 are then preferably collinear relative to one another in the release position.

With regard to the securing element 8, 22, it is important that this is formed in a manner matching the securing region 4, such that the connection between securing element 8, 22 and securing region 4 is well secured against unintentional detachment.

The housing element 8 is movable with respect to the contact element 13, whereby a relative movement can be provided between the contact element 13 and housing element 8. In other words, it can also be said that the contact element 13 is movable relative to the housing element 8. The movement between contact element and housing element 8 is performed along an axis, here along the second axis A2. If the contact element 13 is now in electric contact with the connecting pin 2, the housing element 8 can move from a securing position into a release position relative to the contact element and relative to the connecting pin 2. In the securing position, which is shown in FIG. 4, the housing element 8 with the securing element 22 is connected via a form fit to the securing region 4 of the connecting pin 2. The connection between connecting element 7 and connecting pin 2 is thus secured mechanically, in particular in a form-fitting manner. The form fit thus prevents a movement between the housing element 8, including the contact element 13, relative to the connecting pin 2. As a result, the path of the movement along the first axis A1 between the connecting element 7 and the connecting pin 2 is not released or secured, respectively.

In the release position, the form fit between the securing region 4 and the securing element 22 formed on the housing element 8 is cancelled, such that the connection between connecting element 7 and connecting pin 2 can be cancelled. Here, the housing element 8 is moved relative to the contact element 13 and relative to the connecting pin 2 from the securing region 4, whereby the path of a movement along the first axis A1 is released.

In the present embodiment the securing element 22 is provided by the edge region of the opening 11 in the housing wall 10. This edge region then projects into the securing region 4, here in the form of the furrow or groove 32, respectively.

The securing region 4 of the connecting pin 2 thus preferably has the form of a recess 32, in particular the form of a furrow or groove. The securing element 8, 22 engages accordingly with this recess 32. The recess 32 here provides a stop face 34, with which the securing element 8, 22 engages or into which the securing element 8, 22 protrudes, respectively. The stop face 34 runs at an angle here, in particular at right angles to said first axis A1 and thus at an angle to the direction of movement between the connecting element 7, that is to say the contact element 13, and the connecting pin 2. As a result, the securing element 8, 22 rests against this stop face 34 in the securing position when attempting to separate the electric connection, and the movement in the separation direction is prevented.

The clear width of the securing region 4 or of the recess 32, respectively, is preferably slightly greater than the thickness of the securing element 22 or of the housing wall 10, respectively, which project into the securing region 4.

In order to cancel the connection between the contact element 13 and connecting pin 2, the user has to first bring the securing element 8, 22 from the securing position into the release position. Here, the securing element 8, 22 is drawn from the furrow or groove 32 and therefore can no longer rest against the stop face. As a result, the connection can thus be separated accordingly.

Figure 3:
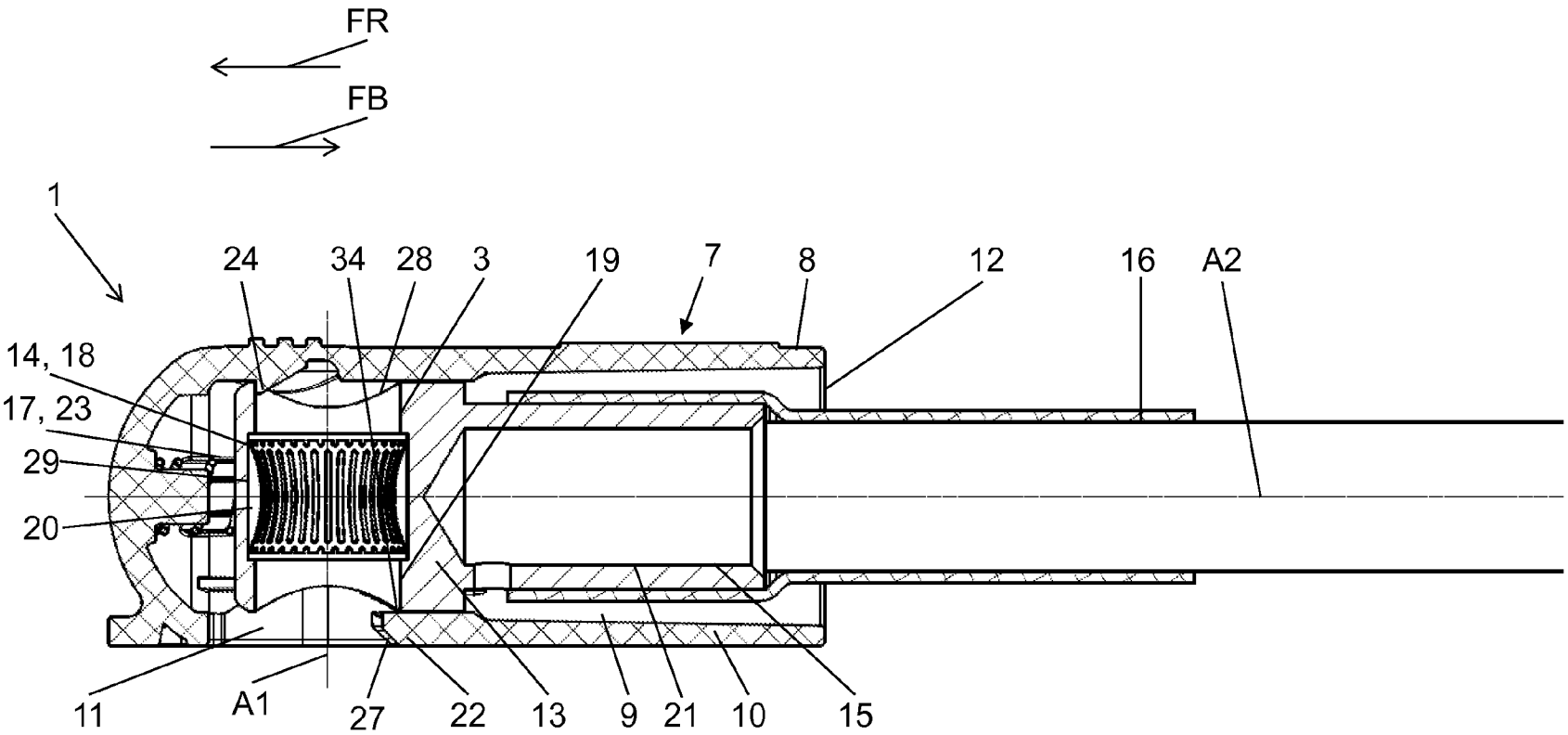
FIG. 3 shows a sectional illustration of the connecting element according to FIGS. 1 and 2.
Figure 4:
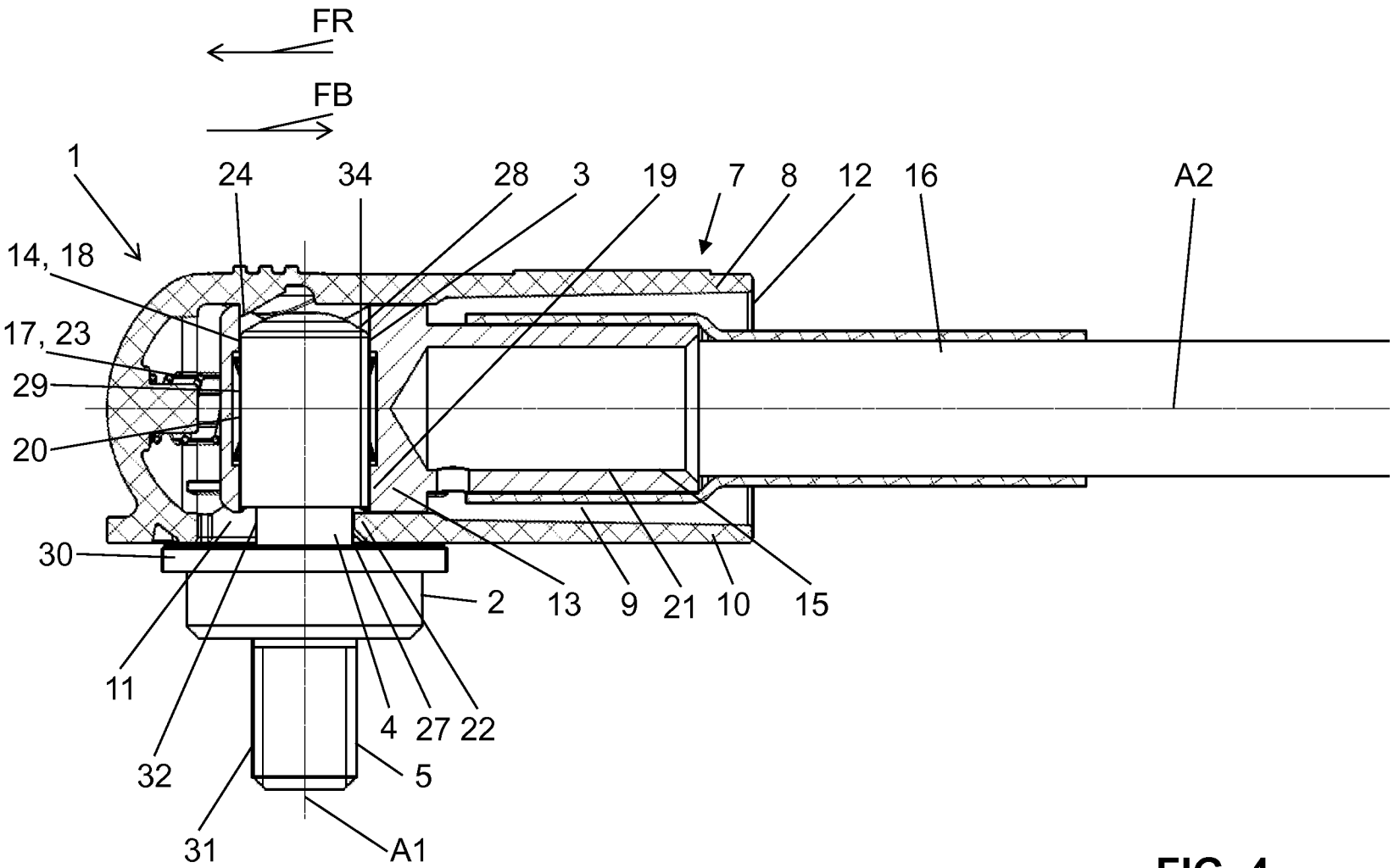
FIG. 4 shows a sectional illustration according to FIG. 3, wherein the connecting pin of the storage battery is additionally shown.
Figure 5:
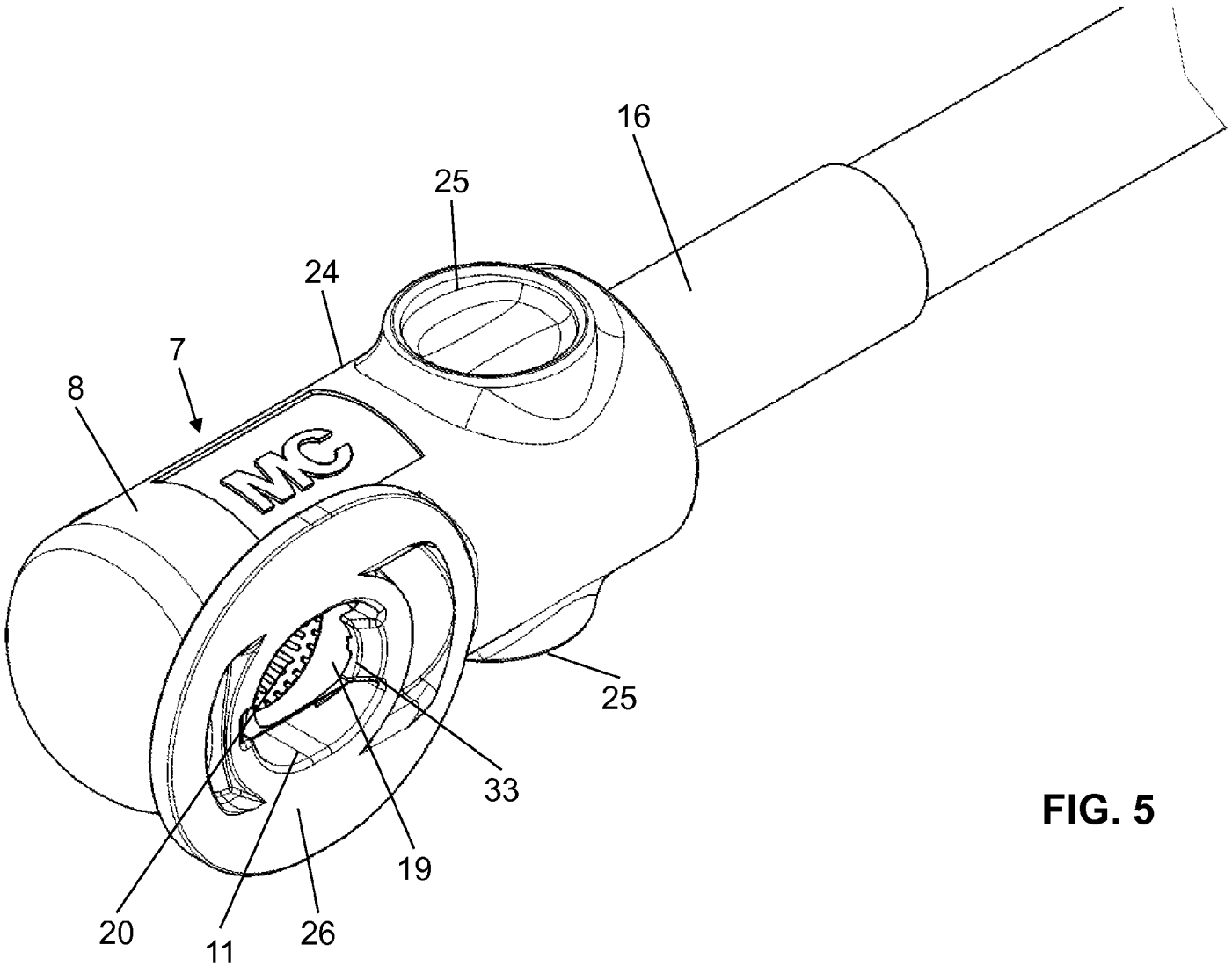
FIG. 5 shows a perspective view according to FIG. 2 without the connecting pin.

As can be seen in FIGS. 3 and 4, the connecting element 1 further comprises a restoring element 17, which provides a restoring force FR on the securing element 8, 22 in a direction from the release position into the securing position, such that the securing element 8, 22 is held in the securing position with the disappearance of an actuation force FB acting against the restoring force. In the present embodiment the restoring element 17 is a spring means, in particular a compression spring 23, arranged between the housing element 4 and the contact element 7. Here, the compression spring 23 provides the restoring force and holds the securing element 22, which here is part of the housing element 8, in the securing position. As a result, the securing element 22 in the securing position automatically latches into the securing region 4 on the connecting pin due to the spring force if the connecting element 7 is connected to the connecting pin.

Further, the securing element 22 optionally has an actuation face 27. The actuation face 27 serves to automatically move the securing element 22 from the securing position into the release position when connecting the connecting element 7 to the connecting pin 2. The actuation face 27, which is sloped with respect to the first axis A1 and thus also with respect to the direction of the movement when producing the connection, comes into contact here with the end face 28 of the connecting pin 2. If force is applied to the connecting element 7 in the direction of the first axis A1, a force on the connecting housing is produced via the sloped actuation face 27, whereby the securing element 22 can be moved from the securing position into the release position, and the securing element 22 thus releases the path for the connection between the connecting element 7 and the connecting pin 2.

The housing element 8 further comprises a stop element 24. The stop element 24 basically provides a delimitation of the movement between the housing element 8 and contact element 17. In other words, it can also be said that the stop element 24 serves to take up the restoring force if the contact element 13 and connecting pin 2 are in the separated state. This can be seen well in FIG. 3. The stop element 24 projects into the socket opening 28 and is thus in contact with the contact element 13, wherein the stop element 24 takes up the force of the spring means 17.

The electric contacting between the connecting element or the contact element 13, respectively, and the connecting pin 2 will now be explained with reference to FIGS. 3 and 4. The first contact portion 14 of the contact element 7 is provided by a socket opening 18, wherein the socket opening 18 has a circumferential side wall 19, which comes into contact with the connecting pin 2, in particular with the lateral surface 29. An electric contact between the contact element 13 and the connecting pin 2 can thus be established between the side wall 19 and the lateral surface 29. A separate and additional contact means 20 may optionally be arranged to improve the electric contact between the connecting pin 2 and the socket opening 18. The contact means 20 is preferably a contact lamella having a plurality of resilient webs which, when producing the connection, deflect slightly and then maintain a spring force during the existence of the connection.

The second contact portion 15 of the contact element 13 is provided here by an opening 21 in the contact element 13, wherein the opening 21 serves to receive and electrically contact the external element 16. Here, the external element 16 has the form of a cable. The external element 16 is then guided out of the housing element 8 via the opening 12.

The first contact portion 14 preferably extends along the first axis A1 and the second contact portion 15 preferably extends along a second axis A2. The first axis A1 is arranged at an angle, preferably at a right angle, to the second axis A2.

It is noted with regard to the second axis that the securing element 22 moves from the securing position into the release position along this second axis A2.

It can be seen well in FIGS. 1 and 2 that the housing element 8 has recessed grips 25 on the outer face 24 of the housing wall 10. The user can apply the actuation force to the housing element 8 via these recessed grips 25 and can move said housing element from the securing position into the release position, that is to say relative to the stationary contact element 13 and relative to the stationary connecting pin 2.

Further, it can be seen in FIGS. 1 and 2 that the opening 11, in which the connecting pin 2 projects into the housing element 8, is surrounded by a flange 26. The flange 26, as viewed in a direction perpendicular to the first axis A1, has a larger diameter than the connecting pin 2. The flange 26 thus extends beyond the connecting pin 2 in the corresponding region. It can be clearly seen in FIG. 2 that the flange 26 of the housing element 8 extends beyond the flange 30 of the connecting pin 2.

LIST OF REFERENCE SIGNS

| | |
|---|---|
| 1 | connecting arrangement |
| 2 | connecting pin |
| 3 | contact region |
| 4 | securing region |
| 5 | connecting region |
| 7 | connecting element |
| 8 | housing element |
| 9 | interior space |
| 10 | housing wall |
| 11 | openings |
| 12 | openings |
| 13 | contact element |
| 14 | first contact portion |
| 15 | second contact portion |
| 16 | first conductive element |
| 17 | restoring element |
| 18 | socket opening |
| 19 | side wall |
| 20 | contact means |
| 21 | opening |
| 22 | securing element |
| 23 | compression spring |
| 24 | outer face |
| 25 | recessed grips |
| 26 | flange |
| 27 | actuation face |
| 28 | end face |
| 29 | lateral surface |
| 30 | flange |
| 31 | thread portion |
| 32 | furrow/groove |
| 33 | tab |
| 34 | stop face |
| FR | restoring force |
| FB | actuation force |

The invention claimed is:

1. A connecting arrangement comprising a connecting pin extending along a first axis and having a contact region, a securing region and a connecting region, and a connecting element having an electrically insulating housing element with a housing wall that delimits an interior space and having a contact element comprising a first contact portion for electrically connecting the connecting element to the contact region of the connecting pin and comprising a second contact portion for electrically connecting the connecting element to the external electrically conductive element, wherein the contact element is arranged in the interior space of the housing element, wherein the contact element can be connected along said first axis to the connecting pin, such that an electrical contact can be established between the contact element and the connecting pin, wherein the connecting element has a securing element that is movable relative to the contact element from a securing position into a release position, wherein if the contact element is contacted with the connecting pin, the securing element is in the securing position, in which it is connected via a form fit to the securing region of the connecting pin, whereby the connection between connecting element and connecting pin is secured in a form-fitting manner, wherein the securing element can be moved from the securing position into the release position, wherein, in the release position, the form fit between securing element and the connecting pin is cancelled and a movement between contact element and connecting pin is thus enabled, and wherein the securing element constitutes an integral part of the housing element, wherein the housing element is movable as a whole relative to the contact element, and wherein the securing element is formed rigidly on the housing element.

2. The connecting arrangement as claimed in claim 1, wherein the securing element or the housing element, respectively, is movable in a direction at right angles to said first axis.

3. The connecting arrangement as claimed in claim 1, wherein the securing element is part of an edge region of an opening in the housing wall, wherein the connecting pin projects through said opening into the housing element.

4. The connecting arrangement as claimed in claim 3, wherein the securing element projects into said opening and reduces the cross section of said opening in part.

5. The connecting arrangement as claimed in claim 3, wherein the securing element is provided by the edge region of the opening itself, wherein the opening is arranged non-concentrically with respect to the first axis of the connecting pin or of the contact element, respectively.

6. The connecting arrangement as claimed in claim 1, wherein the securing region of the connecting pin has the form of a recess, in particular the form of a furrow or groove, with which the securing element engages or into which the securing element projects, respectively, wherein the recess provides a stop face which is oriented at an angle, in particular at right angles, to said first axis, wherein the securing element is in contact with this stop face.

7. The connecting arrangement as claimed in claim 1, wherein the connecting element further comprises a restoring element which provides a restoring force on the securing element in a direction from the release position into the securing position, such that the securing element is held in the securing position with the disappearance of an actuation force acting against the restoring force.

8. The connecting arrangement as claimed in claim 7, wherein the restoring element is a spring element, in particular a compression spring, arranged between the housing element and the contact element.

9. The connecting arrangement as claimed in claim 7, wherein the housing element comprises a stop element, wherein the stop element serves to delimit the movement between the housing element and contact element or to take up the restoring force, respectively, if the contact element and connecting pin are in the separated state.

10. The connecting arrangement as claimed in claim 1, wherein the first contact portion of the contact element is provided by a socket opening, wherein the socket opening has a circumferential side wall which comes into contact with the connecting pin, wherein a contact means, in particular a contact lamella, is optionally arranged between the side wall and the connecting pin.

11. The connecting arrangement as claimed in claim 1, wherein the second contact portion of the contact element is provided by an opening in the contact element, wherein the opening serves to receive and electrically contact the external element.

12. The connecting arrangement as claimed in claim 1, wherein the first contact portion extends along the first axis, and wherein the second contact portion extends along a second axis, wherein the first axis is arranged at an angle, preferably at a right angle, to the second axis.

13. The connecting arrangement as claimed in claim 12, wherein the securing element moves from the securing position into the release position along the second axis.

14. The connecting arrangement as claimed in claim 1, wherein the housing element, on the outer face of the housing wall, has recessed grips, via which the user can apply the actuation force to the housing element.

15. The connecting arrangement as claimed in claim 1, wherein the opening, in which the connecting pin projects into the housing element, is surrounded by a flange, wherein the flange, in a direction perpendicular to the first axis, has a larger diameter than the connecting pin, wherein this flange extends beyond the connecting pin.

* * * * *